United States Patent [19]

Hannah

[11] 4,422,249

[45] Dec. 27, 1983

[54] KICKING APPARATUS

[76] Inventor: William M. Hannah, 4011 W. Camelback, Apt. J-10, Phoenix, Ariz. 85019

[21] Appl. No.: 243,794

[22] Filed: Mar. 16, 1981

[51] Int. Cl.[3] ..... A43B 5/00
[52] U.S. Cl. ..... 36/133
[58] Field of Search ..... 36/133, 128, 132, 136

[56] References Cited

U.S. PATENT DOCUMENTS

| | | | |
|---|---|---|---|
| 3,650,051 | 3/1972 | Sass | 36/133 |
| 3,851,410 | 12/1974 | Frazier | 36/133 |
| 4,065,861 | 1/1978 | Pelfrey | 36/133 |

*Primary Examiner*—Patrick D. Lawson
*Attorney, Agent, or Firm*—Harry M. Weiss

[57] ABSTRACT

This disclosure relates to a kicking shoe which incorporates a defined impact surface formed by a substantially rigid pad overlying the instep to serve as a device to consistently contact a football in a controlled pattern so that the range and accuracy of the kicker are improved.

9 Claims, 6 Drawing Figures

KICKING APPARATUS

BACKGROUND OF THE INVENTION

1. Field of the Invention

This invention relates generally to sports equipment, and, more specifically, to a kicking shoe for use in the traditionally American game of football.

2. Description of the Prior Art

In the past, the game of football has captured the imagination and enthusiasm of a substantial portion of the public. A place kick, wherein a stationary football was kicked either from a tee, or from a held position, was a play typically executed several times in every football game. The ability of a player to accurately kick the stationary football for a substantial distance was a skill highly valued at both amateur and professional levels of the sport. Thus, a continuing need existed for a technique or apparatus to improve the range and/or accuracy of a kicker.

Various attempts have been made to improve the range and accuracy of a stationary football kicked from a tee or from a held position. The traditional kicking technique involved a direct approach by the kicker toward the ball, with the kicking foot being swung in a common plane with the intended trajectory. To improve the range of such a "head-on" kicking technique, hard-faced kicking shoes were introduced, with a block mounted in the toe region which contacted the football. The block in the toe was substantially rigid, and produced a sharper impact upon the football than would an ordinary athletic shoe. The sharper impact in turn increased the range of a kicker.

Subsequently, a technique of "soccer-style" kicking was introduced, wherein the kicker approached a teed-up or held football from a path diagonal to the intended path of travel of the ball. Soccer-style kicking gave the kicker the ability to increase the available momentum by lengthening both the radius and the length of the arc through which the kicking foot was swung, and also permitted the kicker to utilize a larger proportion of the body muscle structure to propel the kicking foot. The actual contact with the ball occurred on the instep of the kicking foot. The resulting notable increase in range produced a general adaptation of the soccer-style kicking technique.

Notwithstanding the developments of the past, football games continued to be won and lost according to the particular range and accuracy abilities of individual kickers, and a need continued to exist for a method or apparatus to improve upon these parameters.

SUMMARY OF THE INVENTION

In accordance with one embodiment of this invention, it is an object to provide a kicking shoe for impacting a football with a rigid pad overlying the instep region of a foot.

It is an object to provide an apparatus to facilitate a soccer-style kick of a football with a planar surface disposed over the instep to tangentially contact a football.

It is another object to teach a method to increase the distance a football can be kicked by mounting a substantially rigid pad over the instep region of a foot.

It is a further object to provide a kicking shoe for impacting a football with a substantially rigid pad overlying the instep region of a foot, which shoe permits the kicker to improve the accuracy of flight of the kicked ball.

It is a further object to provide a kicking shoe for impacting a football with a substantially rigid pad overlying the instep region of a foot, which shoe permits the kicker to improve the precision with which a series of such kicks can be repeated.

It is an object to teach a method of improving the accuracy of a person kicking a football by mounting a pad having a planar surface over the instep region of the kicking foot.

DESCRIPTION OF THE PREFERRED EMBODIMENTS

In accordance with one embodiment of this invention, a soccer-style kicking shoe is disclosed, comprising: cover means for permitting a releasable attachment to a foot of a kicker; and pad means coupled to the cover means and having at least an elongated surface overlying the instep of the foot for providing a regular striking surface with which to impact a football so that the control over the flight of the football can be improved.

In accordance with another embodiment of this invention, a method for permitting an improvement of the range of a football placekicker is disclosed, comprising the step of firmly mounting a substantially rigid pad over the instep region of the kicking foot of the kicker so that a sharp impact can be delivered upon contact with the football.

In accordance with another embodiment of this invention, a method for permitting an improvement in the accuracy of a football placekicker is disclosed, comprising the step of defining a substantially rigid planar surface over the instep region of the kicking foot of the kicker so that a regular defined surface is presented to strike the football.

The foregoing and other objects, features and advantages will be apparent from the following, more particular, description of the preferred embodiments of the invention, as illustrated in the accompanying drawings.

THE SPECIFICATION

Figure 1:
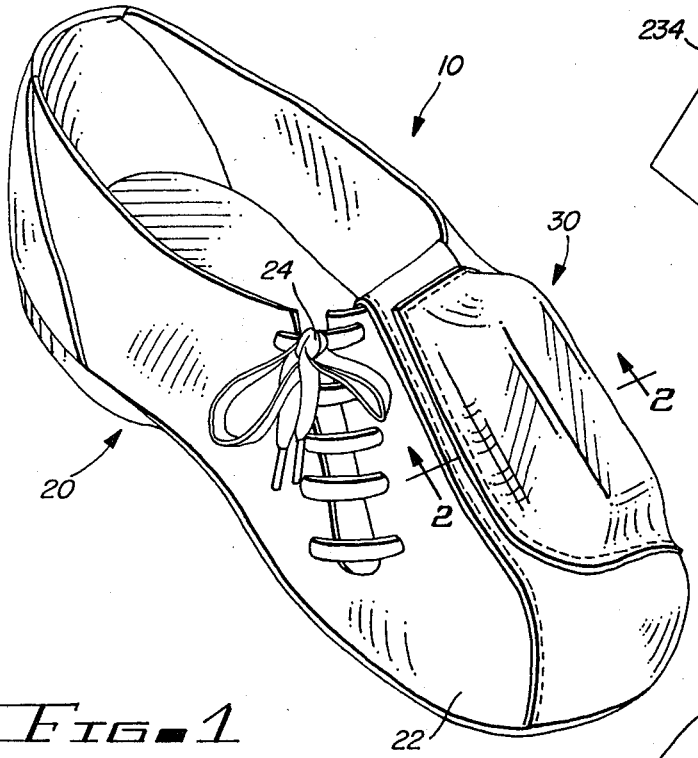
FIG. 1 is a perspective view of a soccer-style kicking shoe.

Referring to FIG. 1, a perspective view of a kicking apparatus is shown generally by reference number 10. The kicking apparatus 10 is provided with a cover as shown generally by reference number 20, which permits the kicking apparatus 10 to be mounted or worn upon the foot of a kicker. In the embodiment of FIG. 1, the cover 20 is an entire shoe 22. The shoe 22 has offset laces 24 which allow the shoe 22 to be tied on and taken off while still permitting a pad apparatus, as shown generally by reference 30, to overlie the contact surface utilized in a soccer-style kick, including the upper and inner contours of the instep region of the foot.

Figure 2:
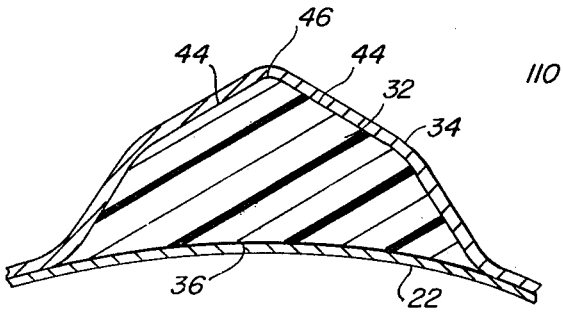
FIG. 2 is a sectional view taken along line 2—2 of FIG. 1.

Referring to FIG. 2, a sectional view taken along line 2—2 of FIG. 1 is shown, additionally disclosing the sectioned structure of the pad apparatus 30 coupled to the cover 20. The pad 30 has a block 32 attached to the shoe 22 by a pocket formed by a sheath 34.

The block 32 has a gently curved lower surface 36, corresponding to the contour of the adjacent instep. The contoured surface 36 distributes the impact of a kicked football over a substantial area of the foot. The block 32 also has a striking surface. In the embodiment shown, the striking surface is defined by first and second planar surfaces 42, 44, which meet to form a kicking edge 46. The composition of the block 32 is not critical, provided the material has sufficient rigidity so as to not deform under the impact of the football. The preferred embodiment of the block 32 utilizes an expanded plastic foam material, to minimize the weight of the block 32.

Figure 3:
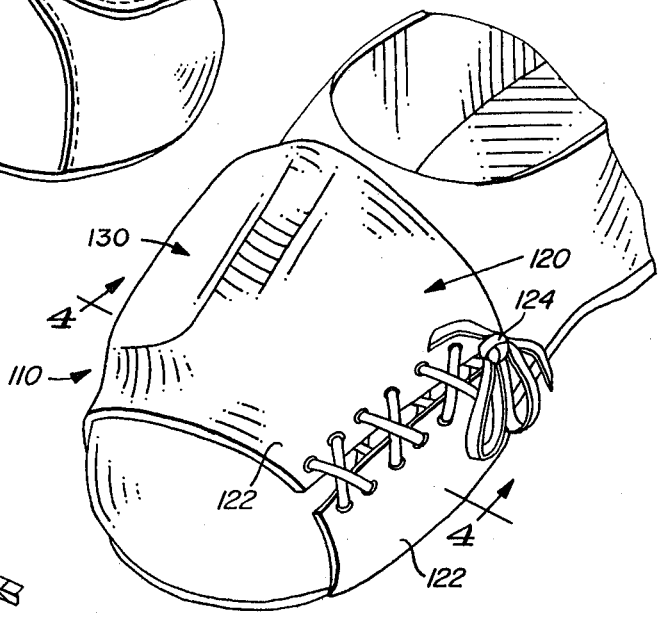
FIG. 3 is a perspective view of an alternate embodiment of a soccer-style kicking shoe.

Referring to FIG. 3, a perspective view of a second embodiment of the kicking apparatus is shown generally by reference number 110. The kicking apparatus 110 has a cover apparatus shown generally by reference number 120, which permits the kicking apparatus 110 to be worn. In the embodiment of FIG. 3, the cover 120 is a strap 122 which girdles the foot. Laces 124, offset with respect to a pad apparatus 130, bind the ends of the strap 122.

Figure 4:
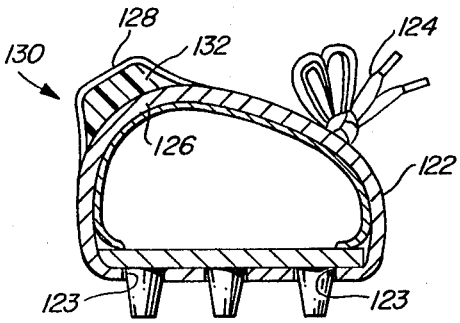
FIG. 4 is a sectional view taken along line 4—4 of FIG. 3.

In FIG. 4, a sectional view taken along line 4—4 of FIG. 3 is shown disclosing the positional relationship between the pad apparatus 130 of the kicking apparatus 110, and the underlying instep of the foot. The pad apparatus 130 includes a block 132 which is retained between inner and outer layers 126, 128 of the strap 122. Holes 123 provide clearance for spikes of the shoe.

Figure 5:
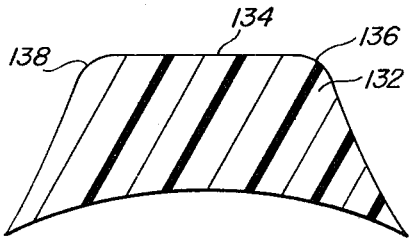
FIG. 5 is a sectional view of the instep pad of the apparatus of FIG. 4.

Referring further to FIG. 5, an enlarged sectional view of the block 132, removed from the strap 122, is shown. The block 132 is contoured to the surface of the instep, but has a planar surface 134 overlying the instep. The planar surface 134 is disposed to tangentially contact a football, and the flanking, opposed edges 136, 138 of the planar surface 134 permit improved control over the flight of the football.

Figure 6:
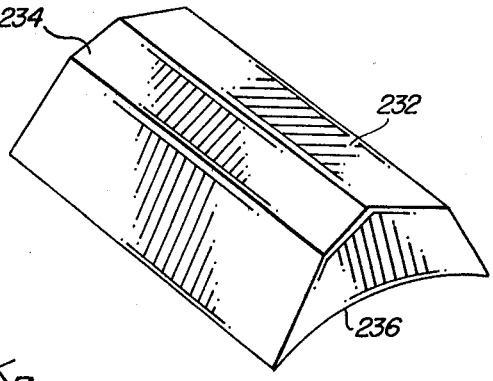
FIG. 6 is a perspective view of another embodiment of an instep pad.

Referring finally to FIG. 6, a perspective view of yet another embodiment of a block, for use in the kicking apparatus 10, is shown by reference number 232. The block 232 has a planar impact surface 234, which overlies the instep contour 236, but which also is deflected toward tangency with the instep contour 236.

While the invention has been particularly described and shown in reference to the preferred embodiments thereof, it will be understood by those skilled in the art that various changes in form and detail and omissions may be made therein without departing from the spirit and scope of the invention.

What is claimed is:

1. A soccer-style place kick type of kicking apparatus, comprising:

cover means for permitting a releasable attachment to a foot of a kicker; and pad means coupled to said cover means having at least a defined elongated, planar football striking portion located substantially parallel to and surface overlying the inside instep portion of said foot for providing a regular striking surface with which to impact a place kicked football so that the control over the flight of the football can be improved.

2. An apparatus in accord with claim 1 wherein said elongated surface comprising at least a planar surface.

3. An apparatus in accord with claim 1 wherein said elongated surface comprising a flat planar surface lying parallel with and along the inside instep of said foot.

4. An apparatus in accord with claim 1 wherein said cover means comprising:

a shoe disposed to substantially encircle said foot; and pocket means coupled to said shoe for firmly locating said pad means upon the inside instep portion of said foot.

5. An apparatus in accord with claim 4, wherein said cover means further comprising lace means for tying said cover to said foot.

6. An apparatus in accord with claim 1, wherein said cover means comprising:

a strap disposed to encircle at least the instep region of said foot; and pocket means coupled to said strap for firmly locating said pad means upon the instep of said foot.

7. A method for permitting an improvement in the range of a football placekicker, comprising the step of firmly mounting a substantially rigid pad substantially parallel to and overlying the inside instep region of the kicking foot of said kicker so that a sharp impact can be delivered upon contact with a football.

8. A method in accord with claim 7, wherein said step of mounting comprising the steps of:

coupling said pad to a shoe; and affixing said shoe upon the kicking foot of said kicker.

9. A method in accord with claim 7 wherein said step of mounting comprising the steps of:

attaching said pad to a strap; and tying said strap to the inside instep region of the kicking foot of the said kicker.

* * * * *